US006697595B2

(12) United States Patent
Kawagoe et al.

(10) Patent No.: US 6,697,595 B2
(45) Date of Patent: Feb. 24, 2004

(54) METHOD AND APPARATUS FOR FORMING AN IMAGE WITH NO DEGRADATION

(75) Inventors: Katsuya Kawagoe, Tokyo (JP); Toshiaki Motohashi, Saitama (JP); Yuuji Sawai, Kanagawa (JP); Shin Kayahara, Kanagawa (JP); Ryuta Takeichi, Kanagawa (JP); Mitsuru Takahashi, Kanagawa (JP); Hiroshi Ono, Tokyo (JP); Hiromi Ogiyama, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/947,391

(22) Filed: Sep. 7, 2001

(65) Prior Publication Data

US 2002/0034406 A1 Mar. 21, 2002

(30) Foreign Application Priority Data

Sep. 7, 2000 (JP) ..... 2000-272196

(51) Int. Cl.[7] ..... G03G 15/16

(52) U.S. Cl. ..... 399/302; 399/308

(58) Field of Search ..... 399/297, 302, 399/303, 308, 312

(56) References Cited

U.S. PATENT DOCUMENTS

| | | | | |
|---|---|---|---|---|
| 5,311,267 | A | * | 5/1994 | Bean ..... 399/164 |
| 5,442,428 | A | | 8/1995 | Takahashi et al. |
| 5,483,330 | A | | 1/1996 | Ogiyama et al. |
| 5,574,558 | A | | 11/1996 | Kudo et al. |
| 5,599,645 | A | | 2/1997 | Tamiya et al. |
| 5,697,031 | A | | 12/1997 | Kamiya et al. |
| 5,697,032 | A | * | 12/1997 | Kimura et al. ..... 399/302 |
| 5,701,566 | A | | 12/1997 | Bisaiji et al. |
| 5,729,024 | A | | 3/1998 | Baba et al. |
| 5,740,492 | A | | 4/1998 | Deki et al. |
| 5,818,062 | A | | 10/1998 | Baba et al. |
| 5,870,650 | A | | 2/1999 | Takahashi et al. |
| 5,873,015 | A | | 2/1999 | Christy |
| 5,890,030 | A | | 3/1999 | Namekata et al. |
| 5,913,092 | A | | 6/1999 | Bisaiji et al. |
| 5,929,436 | A | | 7/1999 | Baba et al. |
| 5,983,060 | A | | 11/1999 | Namekata et al. |
| 6,006,062 | A | | 12/1999 | Takahashi et al. |
| 6,031,633 | A | | 2/2000 | Andoh et al. |
| 6,035,157 | A | | 3/2000 | Takahashi et al. |
| 6,061,543 | A | | 5/2000 | Kayahara et al. |
| 6,074,794 | A | | 6/2000 | Fushimi et al. |
| 6,134,416 | A | | 10/2000 | Tamiya |
| 6,163,661 | A | | 12/2000 | Namekata et al. |
| 6,183,926 | B1 | | 2/2001 | Kuroda et al. |

(List continued on next page.)

FOREIGN PATENT DOCUMENTS

| | | | |
|---|---|---|---|
| JP | 56-149076 | | 11/1981 |
| JP | 63-97976 | | 4/1988 |
| JP | 63-101253 | | 5/1988 |
| JP | 4-45470 | | 2/1992 |
| JP | 4323143 | | 11/1992 |
| JP | 06-175509 | | 6/1994 |
| JP | 8-73066 | * | 3/1996 |
| JP | 11-2936 | * | 1/1999 |
| JP | 2000-66530 | * | 3/2000 |
| JP | 2000-66530 A | * | 3/2000 |
| JP | 2000-162841 | * | 6/2000 |
| JP | 2000-293066 | | 10/2000 |

*Primary Examiner*—Quana M. Grainger
(74) *Attorney, Agent, or Firm*—Oblon, Spivak, McClelland, Maier & Neustadt, P.C.

(57) ABSTRACT

An image forming apparatus including a belt guide member fixedly provided at an upstream side of a nip formed between a roller and a transfer roller so the belt guide member protrudes an image bearing belt such that the belt is substantially parallel with a conveying direction of a transfer medium.

24 Claims, 7 Drawing Sheets

U.S. PATENT DOCUMENTS

| | | | |
|---|---|---|---|
| 6,184,910 | B1 | 2/2001 | Sasaki et al. |
| 6,212,351 | B1 | 4/2001 | Kawagoe et al. |
| 6,223,008 | B1 | 4/2001 | Takahashi et al. |
| 6,252,682 | B1 | 6/2001 | Baba et al. |
| 6,258,502 | B1 | 7/2001 | Nakamura et al. |
| 6,269,228 | B1 | 7/2001 | Kayahara et al. |
| 6,303,258 | B1 | 10/2001 | Katoh et al. |
| 6,363,229 | B1 | 3/2002 | Shiraishi et al. |
| 6,405,002 | B2 | 6/2002 | Ogiyama et al. |

* cited by examiner

METHOD AND APPARATUS FOR FORMING AN IMAGE WITH NO DEGRADATION

CROSS-REFERENCE TO A RELATED APPLICATION

This document claims priority and contains subject matter related to Japanese Patent Application No. 2000-272196, filed on Sep. 7, 2000, the entire contents which are incorporated by reference.

BACKGROUND OF THE INVENTION

1. Field of the Invention

The present invention relates to a method and an apparatus for image formation, and more particularly to a method and an apparatus that can form a high quality image by suppressing an occurrence of toner scatter and a partial omission of a toner image.

2. Discussion of the Background

An image forming apparatus, in which a toner image is formed on a seamless image bearing belt and the toner image is transferred onto a transfer medium by a transfer device, such as a copying machine, a printer, a facsimile, or a multifunctional apparatus having at least the above-described two functions is commonly known. The image bearing member includes, for example, a photoconductive belt on a surface of which a toner image is formed or an intermediate transfer belt onto which the toner image is transferred from a photoconductive element, according to a type of a developing device.

FIG. 10 is a schematic drawing illustrating a construction of a transfer section of a conventional image forming apparatus in which an intermediate transfer belt is used as an image bearing member. As shown, an intermediate transfer belt 1A is spanned around a plurality of rollers including a roller 2A and other rollers (not shown), and is driven in a direction indicated by an arrow "A." Each toner image of different colors is transferred onto the surface of the intermediate transfer belt 1A from a photoconductive element (not shown) one after another while being superimposed on each other. A transfer roller 3A, as an example of a transfer device, is provided at a position opposed to the roller 2A via the intermediate transfer belt 1A.

As illustrated in FIG. 10, the transfer roller 3A press-contacts with the roller 2A via the intermediate transfer belt 1A when a toner image formed on the surface of the intermediate transfer belt 1A is transferred onto a recording medium including a transfer medium 4A. At this time, the transfer roller 3A rotates in a direction indicated by an arrow, and the transfer medium 4A is conveyed in a direction indicated by an arrow "B" to pass through a nip 5A. As described above, the transfer roller 3A press-contacts with the roller 2A via the intermediate transfer belt 1A and the transfer medium 4A. At this time, a transfer voltage with a reverse polarity of toner image formed on the surface of the intermediate transfer belt 1A is applied to the transfer roller 3A.

The toner image formed on the surface of the intermediate transfer belt 1A is then transferred onto the surface of the transfer medium 4A which is conveyed in the direction indicated by the arrow "B" while contacting the surface of the intermediate transfer belt 1A. The transfer medium 4A, which has been conveyed through the nip 5A formed between the roller 2A and the transfer roller 3A, is conveyed to a fixing device so that the toner image transferred onto the surface thereof is fixed.

As explained above, the transfer medium 4A is conveyed to the nip 5A from an inlet side "I." A wedge-shaped gap "G" is formed between the intermediate transfer belt 1A and the transfer medium 4A in a region in the inlet side "I." Further, a portion of the transfer medium 4A, which is placed adjacent to the nip 5, is charged with the reverse polarity of the toner image because the above-described transfer voltage has been applied to the transfer roller 3A. Thus, toner on the surface of the intermediate transfer belt 1A electrostatically flies and adheres to the surface of the transfer medium 4A as indicated by the arrows "C." Such a phenomenon is called "toner scatter." When toner scatter occurs, the scattered toner appears around the image transferred onto the transfer medium 4A, which has passed through the nip 5A, in a blotted condition resulting in a degradation in the quality of the toner image.

The above-described inconvenience is also caused when the image bearing belt includes a photoconductive belt or a dielectric belt and the transfer medium includes an intermediate transfer element or a recording medium. The intermediate transfer belt 1A generally has a volume resistivity of, for example, $10^8$ Ω cm to $10^{13}$ Ω cm. The above-described toner scatter frequently occurs when the intermediate transfer belt 1A is used. A reason for the frequent occurrence of toner scatter is because a force of toner that electrostatically adheres to the surface of the intermediate transfer belt 1A is less than a force of the toner that electrostatically adheres to an insulator. Therefore, the toner adheres to the surface of the intermediate transfer belt 1A in a state that the toner is comparatively easy to move.

Further, toner in an upper-most layer is easily moved when each toner color image is formed on the surface of the intermediate transfer belt 1A while superimposed on each other, because an amount of the toner per unit area on the surface of the intermediate transfer belt 1A is increased. In addition, when the surface of the intermediate transfer belt 1A (on which the toner adheres in the state that it can easily move) is opposed to the charged transfer medium 4A with the minute gap "G" therebetween, the toner on the surface of the intermediate transfer belt 1A easily flies onto the surface of the transfer medium 4A electrostatically, resulting in the frequent occurrence of the toner scatter phenomenon.

As illustrated in FIG. 11, a roller 7A is provided to approximately parallelize a portion of the intermediate transfer belt 1A (which is positioned between the roller 2A opposed to the transfer roller 3A and the roller 7A supporting the intermediate transfer belt 1A) with the conveying direction "B" of the transfer medium 4A conveyed to the nip 5. With this configuration, the transfer medium 4A starts to contact the surface of the intermediate transfer belt 1A at a position substantially upstream from the nip 5 in a moving direction of the intermediate transfer belt 1A. Thus, when a portion 8A of the transfer medium 4A conveyed to a vicinity of the nip 5A is charged by a voltage applied to the transfer roller 3A, the toner on the surface of the intermediate transfer belt 1A does not fly onto the surface of the portion 8A of the transfer medium 4A or a very small amount of the toner flies thereon. Therefore, an occurrence of the toner scatter is suppressed.

In addition, when the diameter of the rollers 2A and 7A supporting the intermediate transfer belt 1A is too small, the intermediate transfer belt 1A passing over the rollers tends to curl. Thus, an uneven transfer of an image to the transfer medium 4A from the intermediate transfer belt 1A arises, resulting in a degenerated toner image. Further, when the diameter of the roller 2A opposed to the transfer roller 3A is too small, a length of the nip 5A (i.e., the nip width) in the conveying direction of the transfer medium 4A is decreased, resulting in a reduction of a transfer efficiency of the toner image. Therefore, the diameter of rollers 2A and 7A cannot be decreased very much.

In addition, when the diameter of the rollers 2A and 7A is increased, a length "D" of the transfer medium 4A, in which the transfer medium 4A contacts the surface of the intermediate transfer belt 1A before the transfer medium 4A reaches the nip 5, is increased. Thus, the transfer medium 4A starts to contact the surface of the intermediate transfer belt 1A at a position substantially upstream from the nip 5 in a moving direction of the transfer medium 4A.

A portion 9A of the transfer medium 4A, which is an upstream side portion of the transfer medium 4A in the conveying direction of the transfer medium 4A, is positioned substantially away from the transfer roller 3A. Therefore, the portion 9A of the transfer medium 4A is not charged by an effect of a voltage applied to the transfer roller 3A. Further, even if the portion 9A of the transfer medium 4A is charged by the effect of the voltage applied to the transfer roller 3A, the potential is very low.

Thus, the portion 9A of the transfer medium 4A does not electrostatically tight-contact the surface of the intermediate transfer belt 1A. Then, the portion 9A of the transfer medium 4A may not be brought into tight-contact with the intermediate transfer belt 1A due to projections and depressions formed on the surface of the intermediate transfer belt 1A or a slack of the intermediate transfer belt 1A caused by a curl given to the intermediate transfer belt 1A. Further, the portion 9A of the transfer medium 4A may slightly deviate from the intermediate transfer belt 1A. In addition, a part of toner image placed between the surface of the intermediate transfer belt 1A and the portion 9A of the transfer medium 4A is then disturbed. By this disturbance, a partial omission of a transferred image may occur (i.e., a concentration of a part of the toner image transferred onto the transfer medium 4A is very low), which degrades the quality of the image.

Further, an image forming apparatus using a transfer device other than a transfer roller is similarly inconvenienced by the above-described inferior image.

SUMMARY OF THE INVENTION

Accordingly, an object of the present invention is to solve the above-mentioned and other problems.

Another object of the present invention is to advantageously provide a novel image forming apparatus and method in which an occurrence of toner scatter and a partial omission of a transferred image, which is caused by a disturbance of toner image, is effectively suppressed.

To solve these and other problems, the present invention provides a novel image forming apparatus including an image bearing belt in an endless form configured to be driven while being spanned around a plurality of rollers, and in which a toner image is formed on a surface of the image bearing belt. Also included is a transfer mechanism disposed at a position opposed to a respective one of the plurality of rollers via the image bearing belt and configured to transfer the toner image formed on the surface of the image bearing belt onto a transfer medium conveyed through a region where said transfer device opposes the respective one of the plurality of rollers with the image bearing belt passing therebetween. Further, a transfer voltage with a reverse polarity of the toner image formed on the surface of the image bearing belt is applied to the transfer device when the toner image is transferred onto the transfer medium. In addition, a belt guide member is also fixedly disposed at an upstream side of the region where the transfer mechanism opposes the respective one of the plurality of rollers in a moving direction of the image bearing belt. The belt guide member is configured to press-contact with an underside of the image bearing belt so as to protrude the image bearing belt such that a portion of the image bearing belt is substantially parallel with a conveying direction of the transfer medium. Further, a side surface the belt guide member that press-contacts with the underside of the image bearing belt includes a flocked surface.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
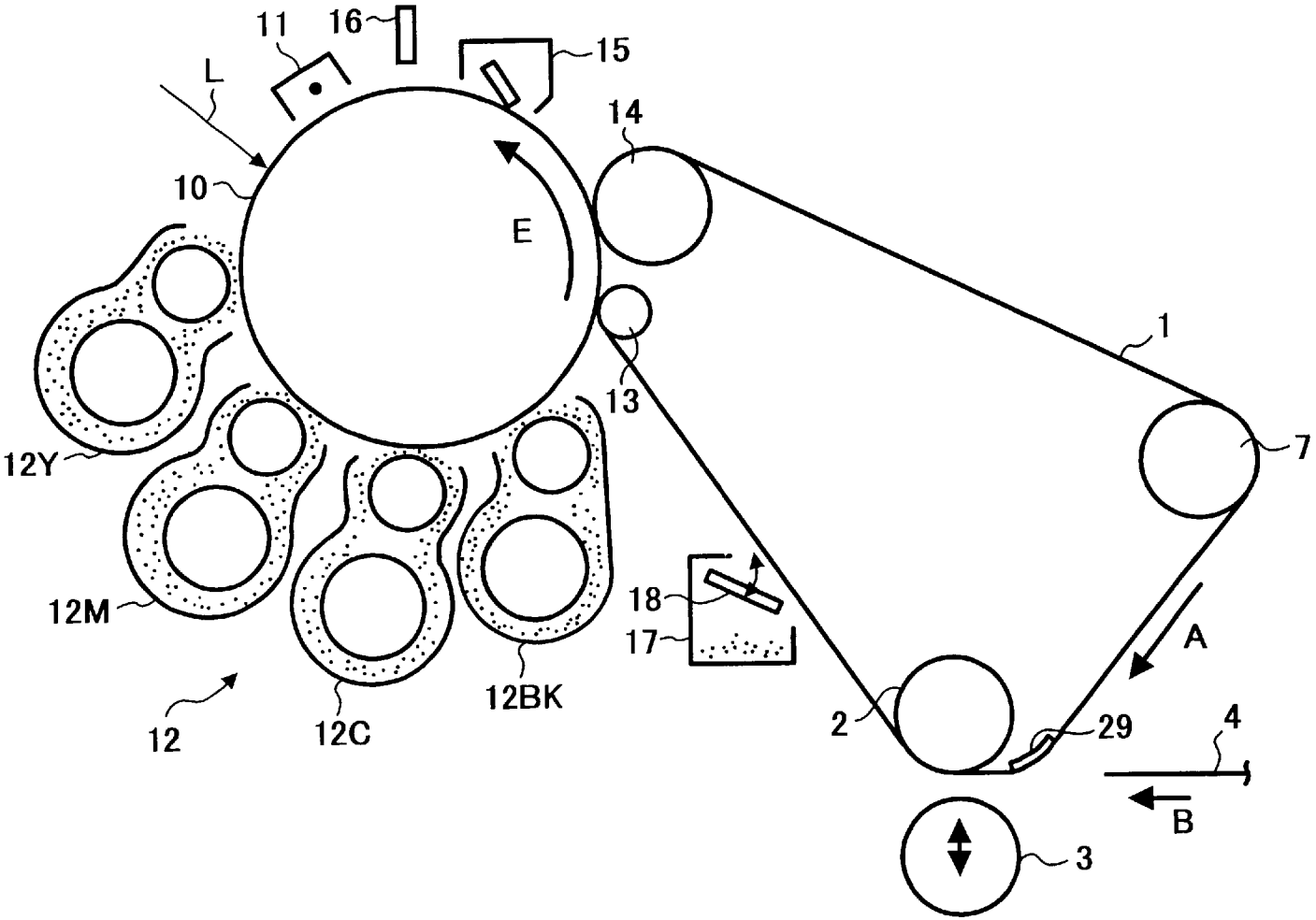
FIG. 1 is a schematic drawing illustrating a construction of an image forming apparatus.

Referring now to the drawings, wherein like reference numerals designate identical or corresponding parts throughout the several views, an example of the present invention will now be described.

FIG. 1 illustrates a construction of an image forming apparatus that can form a color image. In the main body of the image forming apparatus, a drum-shaped photoconductive element 10 is provided that is rotatably driven in a counterclockwise direction as indicated by an arrow "E." A surface of the photoconductive element 10 is uniformly charged with a predetermined polarity by a charging device 11. Further, the surface of the rotating photoconductive element 10 is irradiated with a modulated laser beam "L" which is emitted from a laser unit (not shown). Thus, an electrostatic latent image corresponding to an image signal is formed on the surface of the photoconductive element 10.

In addition, a developing device 12 is arranged at a position opposed to the photoconductive element 10. The developing device 12 includes a yellow developing device 12Y, a magenta developing device 12M, a cyan developing device 12C, and a black developing device 12BK. With a selective operation of each developing device, electrostatic latent images formed on the surface of the photoconductive element 10 in order is developed into a visible image with different color of toner.

Further, around the photoconductive element 10, an intermediate transfer belt 1 is provided as an example of a seamless image bearing belt. The intermediate transfer belt 1 is spanned around a plurality of rollers 2, 13, 14 and 7. Any one of rollers is rotatably driven by a driving device (not shown). The intermediate transfer belt 1 is then driven in a direction indicated by an arrow "A" while contacting the surface of the photoconductive element 10 in synchronization with the rotation of the photoconductive element 10. At this time, a transfer voltage with a reverse polarity of the toner image formed on the surface of the photoconductive element 10 is applied to the roller 14.

Thus, each toner image of the different color is transferred onto the surface of the intermediate transfer belt 1 one after another while being superimposed on each other (i.e., primary transfer). Each time the toner image formed on the surface of the photoconductive element 10 is transferred onto the surface of the intermediate transfer belt 1, residual toner remaining on the surface of the photoconductive element 10 is removed by a cleaning device 15.

Further, a potential of the surface of the photoconductive element 10 is initialized by light from a discharging lamp 16. The intermediate transfer belt 1 as the seamless image bearing belt is driven while being spanned by the plurality of rollers 2, 13, 14, and 7, and a toner image is formed on the surface of the intermediate transfer belt 1.

In addition, a transfer roller 3, as an example of a transfer device, is arranged at a position opposed to one of the plurality of rollers 2, 13, 14, and 17 via the intermediate transfer belt 1. The transfer roller 3 is supported such that it can contact or separate from the surface of the intermediate transfer belt 1. Usually, the transfer roller 3 is separated from the surface of the intermediate transfer belt 1 as shown in FIG. 1. However, the transfer roller 3 press-contacts with the roller 2 via the intermediate transfer belt 1 and a transfer medium 4 when a superimposed toner image of four colors formed on the surface of the intermediate transfer belt 1 is transferred onto the transfer medium 4 (i.e., secondary transfer).

Figure 2:
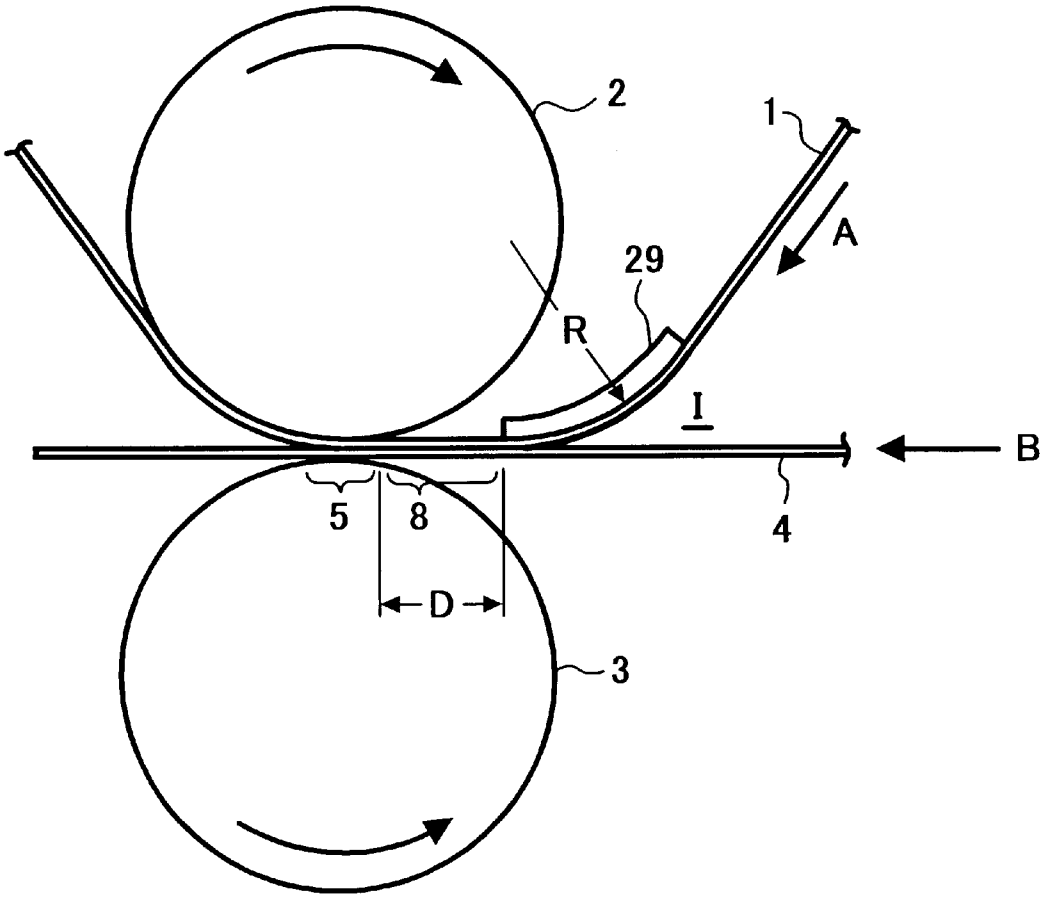
FIG. 2 is an enlarged view illustrating a transfer roller contacting an opposing roller.

The transfer medium 4 is fed from a feeding device (not shown) and is conveyed in a direction indicated by an arrow "B", as shown in FIGS. 1 and 2. Further, the transfer roller 3 press-contacts with the roller 2 immediately before a leading edge of the transfer medium 4 enters into a space formed between the transfer roller 3 and the roller 2. The transfer medium 4 is then conveyed in the direction indicated by the arrow "B" while being sandwiched between the transfer roller 3, which rotates in a counterclockwise direction, and the intermediate transfer belt 1, which moves in a direction indicated by the arrow "A" in synchronization with the rotation of the transfer roller 3.

As described above, the transfer roller 3 is brought into press-contact with the roller 2 via the intermediate transfer belt 1 and the transfer medium 4 conveyed through a nip 5 (see FIG. 2) formed between the transfer roller 3 and the roller 2. At this time, a transfer voltage with a reverse polarity of a toner image formed on the surface of the intermediate transfer belt 1 is applied to the transfer device (i.e., the transfer roller 3). Thus, the toner image formed on the surface of the intermediate transfer belt 1 is transferred onto the transfer medium 4 (i.e., secondary transfer) conveyed through the nip 5. As illustrated in FIG. 1, the transfer roller 3 separates from the roller 2 (i.e., from the surface of the intermediate transfer belt 1) when a trailing edge of the transfer medium 4 passes through the nip 5 formed between the transfer roller 3 and the roller 2.

The toner image transferred on the transfer medium 4 is then fixed onto the transfer medium 4 using heat and pressure while the transfer medium 4 is conveyed through a fixing device (not shown). In addition, residual toner remaining on the surface of the intermediate transfer belt 1 after the toner image has been transferred onto the transfer medium 4 is scraped and removed by a cleaning member 18 of a cleaning device 17. The cleaning member 18 is separated from the surface of the intermediate transfer belt 1 as shown in FIG. 1 at times other than when the residual toner remaining on the surface of the intermediate transfer belt 1 is removed. The cleaning member 18 also press-contacts with the surface of the intermediate transfer belt 1 only when the residual toner remaining on the surface of the intermediate transfer belt 1 is removed.

Further, the transfer medium 4 is any recording medium onto which a toner image is transferred to produce a hard copy, such as a paper, a resin sheet, a resin film, or the like.

As illustrated in FIG. 2, a belt guide member 29 is provided at an upstream side of a region where the transfer roller 3 opposes the roller 2 (i.e., one of the plurality of rollers 2, 13, 14, and 7) in the moving direction of the intermediate transfer belt 1. The belt guide member 29 is fixedly positioned such that it press-contacts with the underside of the intermediate transfer belt 1 so as to protrude the intermediate transfer belt 1 toward the incoming transfer medium 4. In addition, the belt guide member 29 illustrated in FIG. 2 includes a plate-shaped member that contacts an entire width of the underside of the intermediate transfer belt 1. The plate-shaped member also includes a material having a sufficient rigidity, such as a hard resin, a metal, or the like. The belt guide member 29 is also fixedly supported, for example, by a frame of a main body of the image forming apparatus, or a frame of a transfer unit (not shown) to which the rollers 2, 13, 14, and 7 are fixed. Further, the underside of the intermediate transfer belt 1 is the opposite side of the surface of the intermediate transfer belt 1 where a toner image is formed.

In addition, a portion of the intermediate transfer belt 1, which is positioned between the belt guide member 29 and the nip 5, is approximately parallelized with the conveying direction of the transfer medium 4 by providing the belt guide member 29 at an inlet side of the nip 5. Thus, the transfer medium 4 starts to contact the surface of the intermediate transfer belt 1 at an upstream side of the nip 5, where the transfer roller 3 press-contacts with the roller 2, in the moving direction of the intermediate transfer belt 1. That is, the fixedly arranged belt guide member 29 press-contacts with a portion of the underside of the intermediate transfer belt 1 at an upstream side of the nip 5, thereby protruding the portion of the intermediate transfer belt 1 such that the transfer medium 4 contacts the intermediate transfer belt 1 with the above-described timing.

Figure 11:
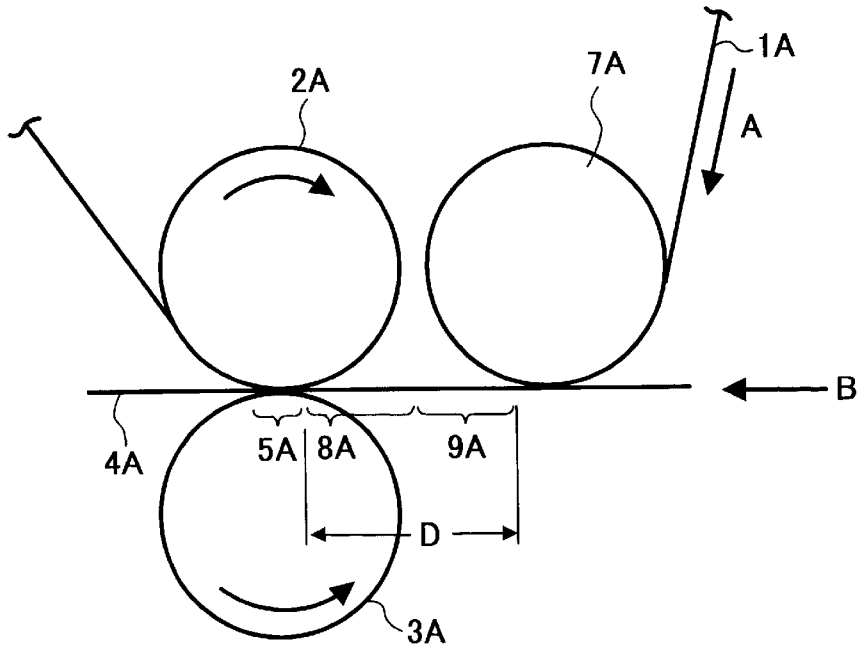
FIG. 11 PRIOR ART
FIG. 11 illustrates another transfer section of a conventional image forming apparatus, in which an additional roller is provided.

With such a configuration, a portion 8 of the transfer medium 4 is brought into tight contact with the surface of the intermediate transfer belt 1 as in the case illustrated in FIG. 11, when the portion 8 is charged by a voltage applied to the transfer roller 3. Thus, toner on the surface of the intermediate transfer belt 1 does not fly and scatter onto the surface of the transfer medium 4 when the toner is electrostatically transferred to the surface of the transfer medium 4, or at least an amount of the flying toner is minimized. An occurrence of a scattered toner is then effectively suppressed, thereby improving a quality of a toner image transferred onto the transfer medium 4.

Further, in the example shown in FIG. 11, a portion 9A of a transfer medium 4A exists that does not electrostatically tight-contact the intermediate transfer belt 1A because a roller 7A is used in place of the belt guide member 29 to have the above-described effect. On the contrary, in the examples shown in FIGS. 1 and 2, the belt guide member 29 is used in place of the roller 7 so that the transfer medium 4 contacts the surface of the intermediate transfer belt 1 early, thus eliminating a portion of the transfer medium 4 which does not electrostatically tight-contact the intermediate transfer belt 1. Further, unlike the roller 7, the belt guide member 29 can be freely formed/set to a desired shape, size or location.

In addition, a length "D", in which a portion of the transfer medium 4 contacts the surface of the intermediate transfer belt 1 before that portion reaches the nip 5 can be set so that a portion of the transfer medium 4, which does not electrostatically tight-contact the intermediate transfer belt 1, does not exist. Thus, an image disturbance caused in the example shown in FIG. 11 is effectively suppressed, resulting in suppression of an occurrence of a partial omission of a toner image transferred onto the transfer medium 4 (i.e., a so called hollow image).

When the above-described length "D" is too long as in the image forming apparatus shown in FIG. 11, a hollow image tends to occur. On the contrary, when the length "D" is too short, toner scatter tends to occur.

Figure 3:
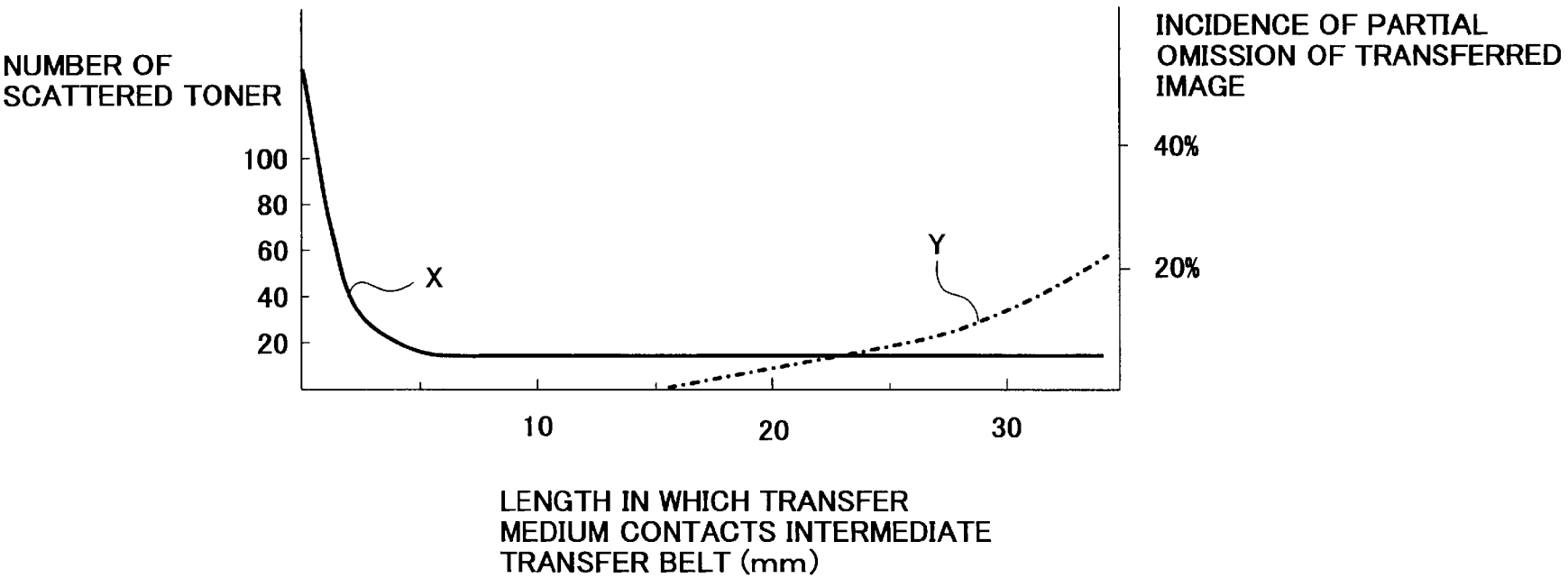
FIG. 3 is a diagram illustrating a relationship between a length in which a transfer medium contacts an intermediate transfer belt, and the number of scattered toner and an incidence of a partial omission of transferred image.

Turning now to FIG. 3, which is a diagram illustrating a number of scattered toner and an incidence of a partial omission of a transferred image corresponding to the length "D." The left-side y-axis represents the number of the scattered toner per unit of a line toner image of 10 mm of a transferred full color image. The right-side y-axis represents the incidence of the partial omission of the transferred image. Further, the x-axis represents the length "D", and a solid line "X" indicates the number of the scattered toner corresponding to the length "D." A chained line "Y" indicates the incidence of the partial omission of the transferred image corresponding to the length "D."

As illustrated by the diagram, the occurrences of scattered toner and partial omission of the transferred image can be reduced so as to improve a quality of the toner image when the length "D" is set at value which is greater than or equal to 2 mm and less than or equal to 30 mm, or preferably, the value which is greater than or equal to 5 mm and less than or equal to 20 mm.

Further, as illustrated in FIG. 2, the belt guide member 29 is bent to protrude toward the surface side of the intermediate transfer belt 1. A radius of a curvature "R" is set at 10 mm or greater, preferably at 15 mm or greater. With the above large curvature radius "R", the intermediate transfer belt 1 guided by the belt guide member 29 is suppressed or prevented from developing a habit of being curled. Thus, an occurrence of an uneven transfer of toner image, which is caused by the curl of the intermediate transfer belt 1, is suppressed.

Figure 4:
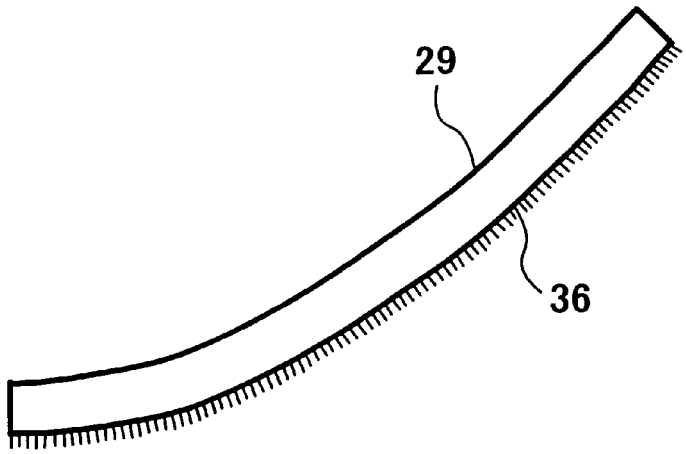
FIG. 4 illustrates a flocked belt guide member.

Further, as illustrated in FIG. 4, when a side surface of the belt guide member 29 contacting the underside of the intermediate transfer belt 1 is flocked, a flock 36 reduces a frictional force exerted on the intermediate transfer belt 1 and the belt guide member 29. As a result, the friction produced between the underside of the intermediate transfer belt 1 and the surface of the belt guide member 29 over time is effectively suppressed.

Figure 5:
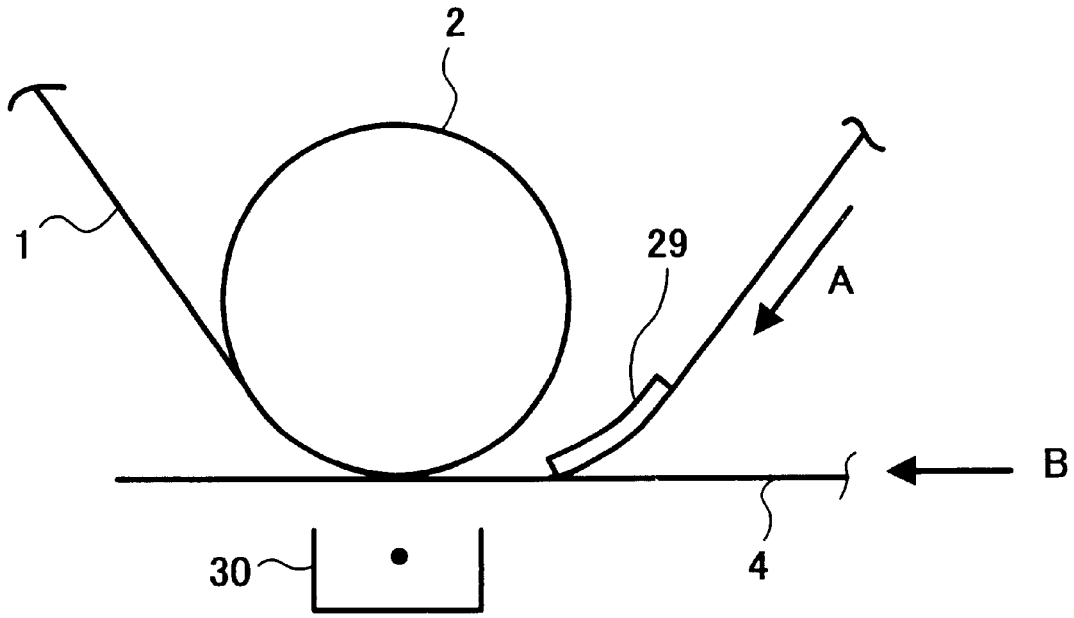
FIG. 5 illustrates a transfer charger as a transfer device.
Figure 6:
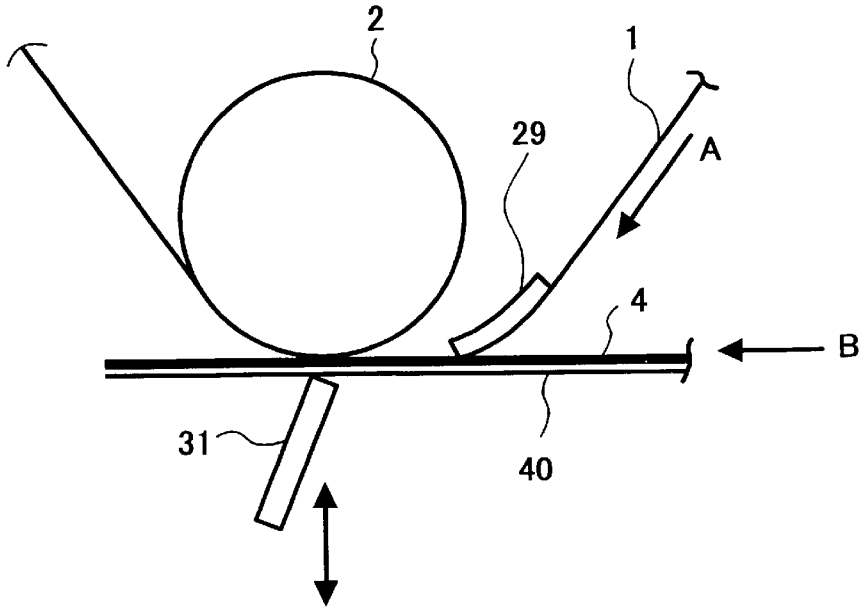
FIG. 6 illustrates a transfer blade as a transfer device.
Figure 7:
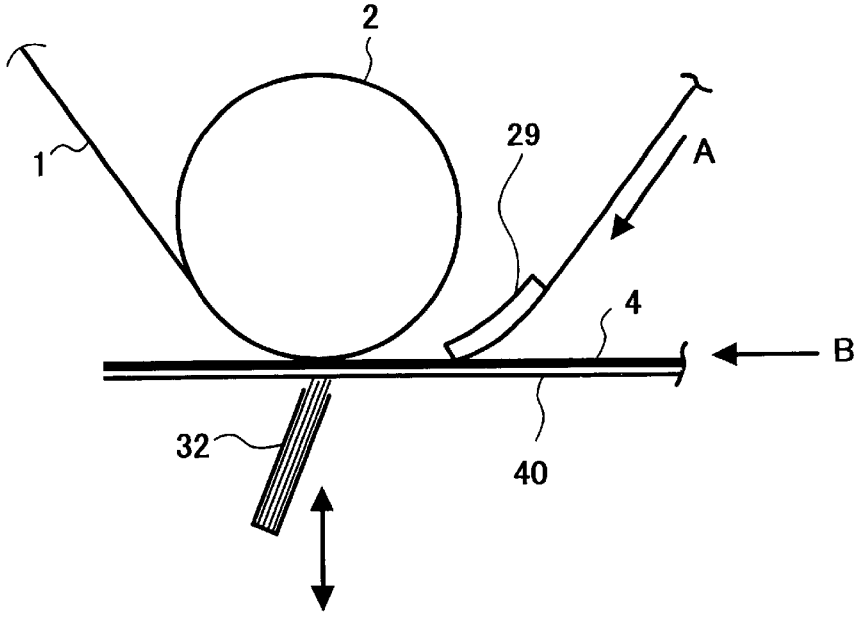
FIG. 7 illustrates a transfer brush as a transfer device.

The above-described belt guide member 29 and its related configuration may also be used even when the transfer device includes a device other than the transfer roller 3. For example, the above-described configuration may be used when (1) the transfer device includes a transfer charger 33 separated from the intermediate transfer belt 1 and placed at a position opposed to the roller 2 as illustrated in FIG. 5, or (2) the transfer medium 4, a conveying belt 40 to bear and convey the transfer medium 4, and a transfer blade 31 (or a transfer brush 32) abutting against the roller 2 via the intermediate transfer belt 1 are included as shown in FIG. 6 or 7. In the example shown in FIG. 5, a transfer voltage is applied to the charging wire of the transfer charger 30. Further, a transfer voltage is applied to the transfer blade 31 and the transfer brush 32 in the examples shown in FIGS. 6 and 7, respectively.

In the above-described image forming apparatus, an image bearing belt includes the intermediate transfer belt 1 in an endless form onto which a toner image formed on a surface of a photoconductive element is transferred (i.e., primary transfer). In addition, the transfer medium 4 includes a recording medium onto which the toner image on the surface of the intermediate transfer belt 1 is transferred (i.e., secondary transfer). Note a dielectric element may be used in place of the photoconductive element.

Figure 8:
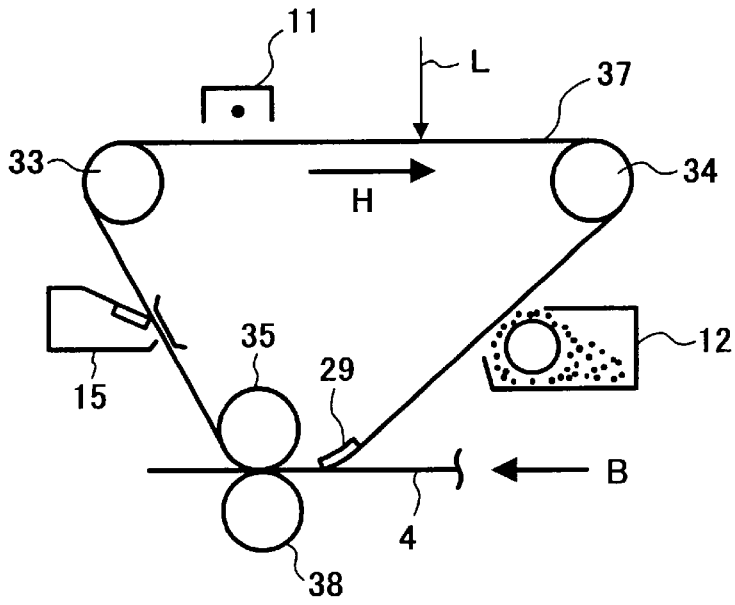
FIG. 8 is a schematic drawing illustrating a construction of an image forming apparatus which is different from that illustrated in FIG. 1.

Further, an image forming apparatus illustrated in FIG. 8 is commonly known. As shown, the image forming apparatus includes a photoconductive belt 37 in an endless form, which is spanned around a plurality of rollers 33, 34, 35 and driven in a direction indicated by an arrow "H." The photoconductive belt 37 is charged with a predetermined polarity by the charging device 11. Also, the charged surface of the photoconductive belt 37 is irradiated with beam light "L" so that an electrostatic latent image is formed. The electrostatic latent image is developed into a toner image by the developing device 12, and the toner image is then transferred onto a recording medium including the transfer medium 4 by a transfer device including, for example, a transfer roller 38.

When the belt guide member 29 is provided at the underside of the photoconductive belt 37, an occurrence of scattered toner and a partial omission of a transferred image is prevented, resulting in an improvement in the quality of the image. Further, in the image forming apparatus, an image bearing belt includes the photoconductive belt 37 on a surface of which an toner image is formed by the developing device 12, and the transfer medium 4 includes a recording medium on which the toner image formed on the surface of the photoconductive belt 37 is transferred. Note a dielectric belt may be used in place of the photoconductive belt 37.

Figure 9:
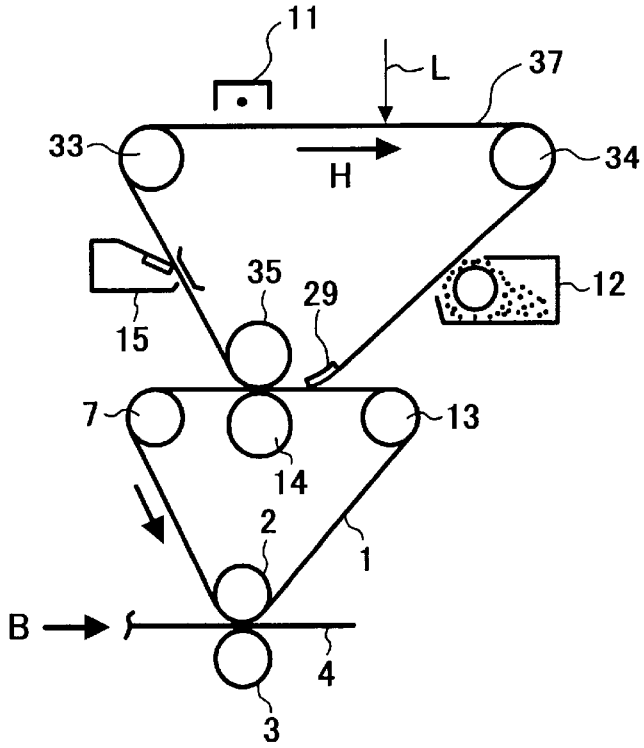
FIG. 9 is a schematic drawing illustrating another construction of an image forming apparatus.
Figure 10:
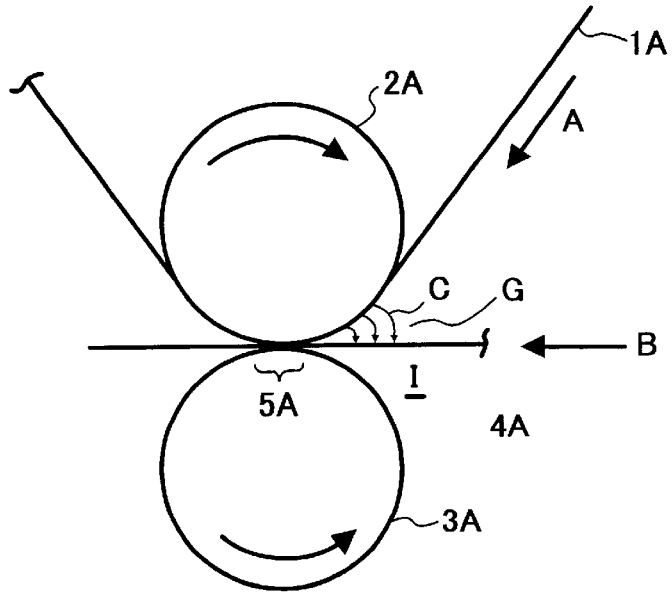
FIG. 10 PRIOR ART
FIG. 10 illustrates a transfer section of a conventional image forming apparatus.

Further, as illustrated in FIG. 9, a toner image maybe formed on the surface of the photoconductive belt 37 in a substantially similar manner to that of the image forming apparatus shown in FIG. 8. That is, the toner image is transferred onto the surface of the intermediate transfer belt 1, which is an example of an intermediate transfer element (i.e., primary transfer). The toner image is then transferred onto the transfer medium 4 by the transfer roller 3 (i.e., secondary transfer).

In the example shown in FIG. 9, the intermediate transfer element includes the intermediate transfer belt 1 spanned around the plurality of rollers 2, 13, 14, and 7. However, a drum-shaped intermediate transfer element may be employed in place of the intermediate transfer belt 1. In an image forming apparatus having the above-described configuration, an improvement in image quality can be obtained by preventing an occurrence of a scattered toner and a partial omission of a transferred image when the belt guide member 29 is provided at the underside of the photoconductive belt 37.

According to this example, an image bearing belt includes the photoconductive belt 37 on a surface of which a toner image is formed by the developing device 12. A transfer medium includes an intermediate transfer element onto which the toner image formed on the surface of the photoconductive belt 37 is transferred. In this case, a dielectric belt may be used in place of the photoconductive belt 37. Further, reference numeral "15" in FIGS. 8 and 9 denotes a cleaning device which removes residual toner remaining on the surface of the photoconductive belt 37 after toner image has been transferred.

Obviously, numerous additional modifications and variations of the present invention are possible in light of the above teachings. It is therefore to be understood that within the scope of the appended claims, the present invention may be practiced otherwise than as specifically described herein.

What is claimed is:

1. An image forming apparatus, comprising:

an image bearing belt in an endless form configured to be driven while being spanned around a plurality of rollers, and in which a toner image is formed on a surface of said image bearing belt;

a transfer mechanism disposed at a position opposed to a respective one of the plurality of rollers with the image bearing belt passing therebetween and configured to transfer the toner image formed on the surface of the image bearing belt onto a transfer medium conveyed through a region where said transfer mechanism opposes the respective one of the plurality of rollers, and in which a transfer voltage with a reverse polarity of the toner image is applied to said transfer mechanism so as to transfer the toner image onto the transfer medium; and a belt guide member fixedly positioned at an upstream side of the region where the transfer mechanism opposes the respective one of the plurality of rollers, such that the belt guide member constantly press-contacts with an underside of said image bearing belt so as to protrude the image bearing belt such that a portion of the image bearing belt is substantially parallel with a conveying direction of the transfer medium and such that the transfer medium contacts the surface of the image bearing belt at an upstream side of the position where the transfer mechanism opposes the respective one of the plurality of rollers, wherein a side surface of the belt guide member that press-contacts with the underside of the image bearing belt includes a flocked surface.

2. The image forming apparatus according to claim 1, wherein the transfer mechanism includes one of a transfer roller, a transfer charger, a transfer blade, and a transfer brush.

3. The image forming apparatus according to claim 1, wherein the transfer mechanism includes a transfer roller configured to press-contact the respective one of the plurality of rollers, and wherein a length D in which a portion of the transfer medium tightly contacts the surface of the image bearing belt before reaching a nip formed between the transfer roller and the respective one of the plurality of rollers is set as:

$2\ \text{mm} \leqq D \leqq 30\ \text{mm}$.

4. The image forming apparatus according to claim 1, wherein the belt guide member has a radius of a curvature set at 10 mm or greater.

5. The image forming apparatus according to claim 1, wherein the image bearing belt is an intermediate transfer belt in an endless form on a surface of which a toner image formed on a surface of a photoconductive element is transferred, and wherein the transfer medium includes a recording medium onto which the toner image transferred onto the surface of the intermediate transfer belt is transferred.

6. The image forming apparatus according to claim 1, wherein said image bearing belt is a photoconductive belt on a surface of which a toner image is formed by a developing device, and wherein the transfer medium includes a recording medium onto which the toner image formed on the surface of the photoconductive belt is transferred.

7. The image forming apparatus according to claim 1, wherein said image bearing belt is a photoconductive belt on a surface of which a toner image is formed by a developing device, and wherein the transfer medium includes an intermediate transfer element onto which the toner image formed on the surface of the photoconductive belt is transferred.

8. An image forming system, comprising:

an image bearing means driven while being spanned around a plurality of rollers, and in which a toner image is formed on a surface of said image bearing belt;

a transfer means disposed at a position opposed to a respective one of the plurality of rollers with the image bearing means passing therebetween for transferring the toner image formed on the surface of the image bearing means onto a transfer medium conveyed through a region where said transfer means opposes the respective one of the plurality of rollers, and in which a transfer voltage with a reverse polarity of the toner image is applied to said transfer means so as to transfer the toner image onto the transfer medium; and a belt guiding means fixedly positioned at an upstream side of the region where the transfer means opposes the respective one of the plurality of rollers, such that the belt guiding means constantly press-contacts with an underside of said image bearing means so as to protrude the image bearing means such that a portion of the image bearing means is substantially parallel with a conveying direction of the transfer medium and such that the transfer medium contacts the surface of the image bearing means at an upstream side of the position where the transfer means opposes the respective one of the plurality of rollers, wherein a side surface of the belt guiding means that press-contacts with the underside of the image bearing means includes a flocked surface.

9. The image forming system according to claim 8, wherein the transfer means includes one of a transfer roller, a transfer charger, a transfer blade, and a transfer brush.

10. The image forming system according to claim 8, wherein the transfer means includes a transfer roller configured to press-contact the respective one of the plurality of rollers, and wherein a length D in which a portion of the transfer medium tightly contacts the surface of the image bearing means before reaching a nip formed between the transfer roller and the respective one of the plurality of rollers is set as:

$2\ \text{mm} \leqq D \leqq 30\ \text{mm}$.

11. The image forming system according to claim 8, wherein the belt guiding means has a radius of a curvature set at 10 mm or greater.

12. The image forming system according to claim 8, wherein the image bearing means is an intermediate transfer belt in an endless form on a surface of which a toner image formed on a surface of a photoconductive element is transferred, and wherein the transfer medium includes a recording medium onto which the toner image transferred onto the surface of the intermediate transfer belt is transferred.

13. The image forming system according to claim 8, wherein said image bearing means is a photoconductive belt on a surface of which a toner image is formed by a developing device, and wherein the transfer medium includes a recording medium onto which the toner image formed on the surface of the photoconductive belt is transferred.

14. The image forming system according to claim 8, wherein said image bearing means is a photoconductive belt on a surface of which a toner image is formed by a developing device, and wherein the transfer medium includes an intermediate transfer element onto which the toner image formed on the surface of the photoconductive belt is transferred.

15. An image forming method, comprising:

forming a toner image on a surface of an image bearing belt in an endless form driven while being spanned around a plurality of rollers;

transferring, via a transfer mechanism disposed at a position opposed to a respective one of the plurality of rollers with the image bearing belt passing therebetween, the toner image formed on the surface of the image bearing belt onto a transfer medium conveyed through a region where said transfer device opposes the respective one of the plurality of rollers;

applying a transfer voltage with a reverse polarity of the toner image to said transfer mechanism so as to transfer the toner image onto the transfer medium; and fixedly positioning a belt guide member at an upstream side of the region where the transfer device opposes the respective one of the plurality of rollers so as to constantly press-contact with an underside of said image bearing belt and protrude the image bearing belt such that a portion of the image bearing belt is substantially parallel with a conveying direction of the transfer medium and such that the transfer medium contacts the surface of the image bearing belt at an upstream side of the position where the transfer mechanism opposes the respective one of the plurality of rollers, wherein a side surface of the belt guide member that press-contacts with the underside of the image bearing belt includes a flocked surface.

16. The method according to claim 15, wherein the transfer mechanism includes one of a transfer roller, a transfer charger, a transfer blade, and a transfer brush.

17. The method according to claim 15, wherein the transfer mechanism includes a transfer roller configured to press-contact the respective one of the plurality of rollers, and wherein a length D in which a portion of the transfer medium tightly contacts the surface of the image bearing belt before reaching a nip formed between the transfer roller and the negative one of the plurality of rollers is set as:

$2\ \text{mm} \leqq D \leqq 30\ \text{mm}$.

18. The method according to claim 15, wherein the belt guide member has a radius of a curvature set at 10 mm or greater.

19. The method according to claim 15, wherein the image bearing belt is an intermediate transfer belt in an endless form on a surface of which a toner image formed on a surface of a photoconductive element is transferred, and wherein the transfer medium includes a recording medium onto which the toner image transferred onto the surface of the intermediate transfer belt is transferred.

20. The method according to claim 15, wherein said image bearing belt is a photoconductive belt on a surface of which a toner image is formed by a developing device, and wherein the transfer medium includes a recording medium onto which the toner image formed on the surface of the photoconductive belt is transferred.

21. The method according to claim 15, wherein said image bearing belt is a photoconductive belt on a surface of which a toner image is formed by a developing device, and wherein the transfer medium includes an intermediate transfer element onto which the toner image formed on the surface of the photoconductive belt is transferred.

22. An image forming apparatus, comprising:

an image bearing belt in an endless form configured to be driven while being spanned around a plurality of rollers, and in which a toner image is formed on a surface of said image bearing belt;

a transfer mechanism disposed at a position opposed to a respective one of the plurality of rollers with the image bearing belt passing therebetween and configured to transfer the toner image formed on the surface of the image bearing belt onto a transfer medium conveyed through a region where said transfer mechanism opposes the respective one of the plurality of rollers, and in which a transfer voltage with a reverse polarity of the toner image is applied to said transfer mechanism so as to transfer the toner image onto the transfer medium; and a belt guide member fixedly disposed at an upstream side of the region where the transfer mechanism opposes the respective one of the plurality of rollers, and configured to press-contact with an underside of said image bearing belt so as to protrude the image bearing belt such that a portion of the image bearing belt is substantially parallel with a conveying direction of the transfer medium, wherein a side surface of the belt guide member that press-contacts with the underside of the image bearing belt includes a flocked surface, and wherein the belt guide member has a radius of a curvature set at 10 mm or greater.

23. An image forming system, comprising:

an image bearing means driven while being spanned around a plurality of rollers, and in which a toner image is formed on a surface of said image bearing belt;

a transfer means disposed at a position opposed to a respective one of the plurality of rollers with the image bearing means passing therebetween for transferring the toner image formed on the surface of the image bearing means onto a transfer medium conveyed through a region where said transfer means opposes the respective one of the plurality of rollers, and in which a transfer voltage with a reverse polarity of the toner image is applied to said transfer means so as to transfer the toner image onto the transfer medium; and a belt guiding means fixedly disposed at an upstream side of the region where the transfer mechanism opposes the respective one of the plurality of rollers, and for press-contacting with an underside of said image bearing means so as to protrude the image bearing means such that a portion of the image bearing means is substantially parallel with a conveying direction of the transfer medium, wherein a side surface of the belt guiding means that press-contacts with the underside of the image bearing belt includes a flocked surface, and wherein the belt guiding means has a radius of a curvature set at 10 mm or greater.

24. An image forming method, comprising:

forming a toner image on a surface of an image bearing belt in an endless form driven while being spanned around a plurality of rollers;

transferring, via a transfer mechanism disposed at a position opposed to a respective one of the plurality of rollers with the image bearing belt passing therebetween, the toner image formed on the surface of the image bearing belt onto a transfer medium conveyed through a region where said transfer device opposes the respective one of the plurality of rollers;

applying a transfer voltage with a reverse polarity of the toner image to said transfer mechanism so as to transfer the toner image onto the transfer medium; and fixedly providing a belt guide member at an upstream side of the region where the transfer device opposes the respective one of the plurality of rollers so as to press-contact with an underside of said image bearing belt and protrude the image bearing belt such that a portion of the image bearing belt is substantially parallel with a conveying direction of the transfer medium, wherein a side surface of the belt guide member that press-contacts with the underside of the image bearing belt includes a flocked surface, and wherein the belt guide member has a radius of a curvature set at 10 mm or greater.

* * * * *